US008347913B2

(12) United States Patent
Zhu

(10) Patent No.: US 8,347,913 B2
(45) Date of Patent: Jan. 8, 2013

(54) COMBUSTIBLE FUEL PIPING SYSTEM AND COMBUSTIBLE FUEL SUPPLY SYSTEM USING THE SAME

(75) Inventor: Yimin Zhu, Chongqing (CN)

(73) Assignee: Yimin Zhu, Chongquing (CN)

( * ) Notice: Subject to any disclaimer, the term of this patent is extended or adjusted under 35 U.S.C. 154(b) by 484 days.

(21) Appl. No.: 12/721,050

(22) Filed: Mar. 10, 2010

(65) Prior Publication Data

US 2011/0220225 A1 Sep. 15, 2011

(51) Int. Cl.
*F17D 1/02* (2006.01)

(52) U.S. Cl. ..... 137/571; 137/587; 137/625.18; 137/597; 123/516; 123/468

(58) Field of Classification Search ..... 137/571, 137/572, 587, 563, 597, 625.18, 625.19, 137/204; 123/516, 468
See application file for complete search history.

(56) References Cited

U.S. PATENT DOCUMENTS 1,426,505 A * 8/1922 Replogle ..... 137/571
3,044,491 A * 7/1962 Sangster ..... 137/625.18
3,162,235 A * 12/1964 Capehart ..... 137/109
3,896,029 A * 7/1975 Beuselinck ..... 210/341
4,175,527 A * 11/1979 Sanada et al. ..... 123/514
4,401,095 A * 8/1983 DuLoft ..... 123/590
4,784,104 A * 11/1988 Dimond ..... 123/514
5,437,304 A * 8/1995 Delcroix ..... 137/595
6,152,176 A * 11/2000 Lin ..... 137/625.21
7,263,981 B2 * 9/2007 Woody ..... 123/517
7,591,251 B1 * 9/2009 Roche et al. ..... 123/516
8,235,027 B2 * 8/2012 Guterres et al. ..... 123/516
2005/0178368 A1 * 8/2005 Donahue et al. ..... 123/520
2006/0107932 A1 * 5/2006 Shibata et al. ..... 123/516
2007/0039653 A1 * 2/2007 Maggard ..... 137/625.19
2010/0258094 A1 * 10/2010 Hull et al. ..... 123/536

* cited by examiner

*Primary Examiner* — Eric Keasel
*Assistant Examiner* — Minh Le
(74) *Attorney, Agent, or Firm* — Holland & Hart LLP

(57) ABSTRACT

A combustible fuel supply system includes a fuel tank, a carburetor and a combustible fuel piping system. The combustible fuel piping system includes a fuel-feeding pipe, a fuel-drawing pipe, a vent pipe, and a switch valve. The fuel-feeding pipe interconnects the carburetor and a lower space of the fuel tank that stores combustible fuel. The fuel-drawing pipe interconnects the carburetor and an upper space of the fuel tank that accommodates air when the lower space stores the combustible fuel. The vent pipe is for fluid communication between the upper space and the exterior of the fuel tank. The switch valve is operable to obstruct fluid flow through at least one of the fuel-feeding pipe, the fuel-drawing pipe and the vent pipe, and is operable to switch between a fuel-feeding state and a fuel-drawing state for obstructing and permitting fluid flow through at least one of the pipes.

2 Claims, 3 Drawing Sheets

COMBUSTIBLE FUEL PIPING SYSTEM AND COMBUSTIBLE FUEL SUPPLY SYSTEM USING THE SAME

BACKGROUND OF THE INVENTION

1. Field of the Invention

The present invention relates to a combustible fuel supply system, more particularly to a combustible fuel supply system including a combustible fuel piping system capable of drawing combustible fuel out of a carburetor of the combustible fuel supply system.

2. Description of the Related Art

Referring to FIG. 1, a conventional combustible fuel supply system includes a fuel tank 1, a carburetor 21, a fuel-feeding pipe 22, and a switch 23. The fuel tank 1 is used for storing combustible fuel. The carburetor 21 is used for atomizing the combustible fuel so as to produce a mixture of combustible fuel and air, and for providing the mixture of the combustible fuel and air to an engine (not shown). The fuel tank 1 includes a tank body 11 formed with an opening 111, and a cap 13 for removably covering the opening 111. The cap 13 is formed with a vent hole 14 for fluid communication between the interior and exterior of the fuel tank 1 such that the pressure inside the fuel tank 1 is equal to the atmospheric pressure. The casing 11 defines an upper space 122 and a lower space 121 in fluid communication with each other. The lower space 121 is used for storing the combustible fuel. The upper space 122 is adapted for accommodating air when the lower space 121 stores the combustible fuel, and is in fluid communication with the vent hole 14. The carburetor 21 includes a screw bolt 211 for draining residual combustible fuel from the carburetor 21.

The fuel-feeding pipe 22 interconnects the lower space 121 of the fuel tank 1 and the carburetor 21. The switch 23 is disposed at the fuel-feeding pipe 22, and is operable to switch between a fuel-feeding state and an obstructing state so as to permit or obstruct fluid flow through the fuel-feeding pipe 22.

As shown in FIG. 1, when the switch 23 is in the fuel-feeding state, the fluid flow through the fuel-feeding pipe 22 is permitted. Moreover, by virtue of the vent hole 14, the pressure inside the fuel tank 1 is equal to the atmospheric pressure, and is not a negative pressure compared with the pressure in the carburetor 21. Further, operation of the engine causes the carburetor 21 to generate a force that causes the combustible fuel stored in the lower space 121 of the fuel tank 1 to flow into the carburetor 21 through the fuel-feeding pipe 22. Then, the carburetor 21 atomizes the combustible fuel, and the resulting mixture of the combustible fuel and air is fed into the engine subsequently. Thus, the switch 23 can be switched to the fuel-feeding state before operation of the engine. Further, when the switch 23 is in the obstructing state (not shown), the fluid flow through the fuel-feeding pipe 22 is obstructed. Therefore, the combustible fuel stored in the lower space 121 of the fuel tank 1 cannot flow into the carburetor 21 through the fuel-feeding pipe 22. Thus, the switch 23 can be switched to the obstructing state after stopping the engine.

Generally, a portion of the combustible fuel flowing into the carburetor 21 during operation of the engine remains therein. When the engine is not operated for a long time, gelatinous substance attributed to volatilization of the residual combustible fuel in the carburetor 21 can cause difficulty in starting the engine, and can even result in inability to start the engine. In order to overcome such problem, the screw bolt 211 of the carburetor 21 requires manually removal for draining the combustible fuel from the carburetor 21. However, such manual draining is inconvenient to conduct.

SUMMARY OF THE INVENTION

Therefore, an object of the present invention is to provide a combustible fuel supply system including a fuel tank, a carburetor, and a combustible fuel piping system for interconnecting the fuel tank and the carburetor. The combustible fuel piping system is capable of drawing combustible fuel out of the carburetor, and even permitting return flow of the combustible fuel from the carburetor back to the fuel tank.

Accordingly, a combustible fuel supply system of the present invention includes a fuel tank, a carburetor and a combustible fuel piping system.

The fuel tank includes a casing that defines an upper space and a lower space in fluid communication with each other. The lower space is adapted for storing combustible fuel. The upper space is adapted for accommodating air when the lower space stores the combustible fuel. The combustible fuel piping system comprises a fuel-feeding pipe, a fuel-drawing pipe, a vent pipe, and a switch valve.

The fuel-feeding pipe interconnects the lower space of the fuel tank and the carburetor. The fuel-drawing pipe interconnects the upper space of the fuel tank and the carburetor. The vent pipe is used for fluid communication between the upper space and the exterior of the fuel tank. The switch valve is operable to obstruct fluid flow through at least one of the fuel-feeding pipe, the fuel-drawing pipe and the vent pipe.

The switch valve is operable to switch between a fuel-feeding state and a fuel-drawing state. When the switch valve is in the fuel-feeding state, fluid flow through the fuel-drawing pipe is obstructed, fluid flow through the fuel-feeding pipe and the vent pipe is permitted, and the lower space and the carburetor are in fluid communication through the fuel-feeding pipe so as to feed the combustible fuel stored in the lower space to the carburetor. When the switch valve is in the fuel-drawing state, fluid flow through the fuel-feeding pipe and the vent pipe is obstructed, fluid flow through the fuel-drawing pipe is permitted, and the upper space and the carburetor are in fluid communication through the fuel-drawing pipe so as to draw combustible fuel out of the carburetor by virtue of a pressure difference between the fuel tank and the carburetor.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
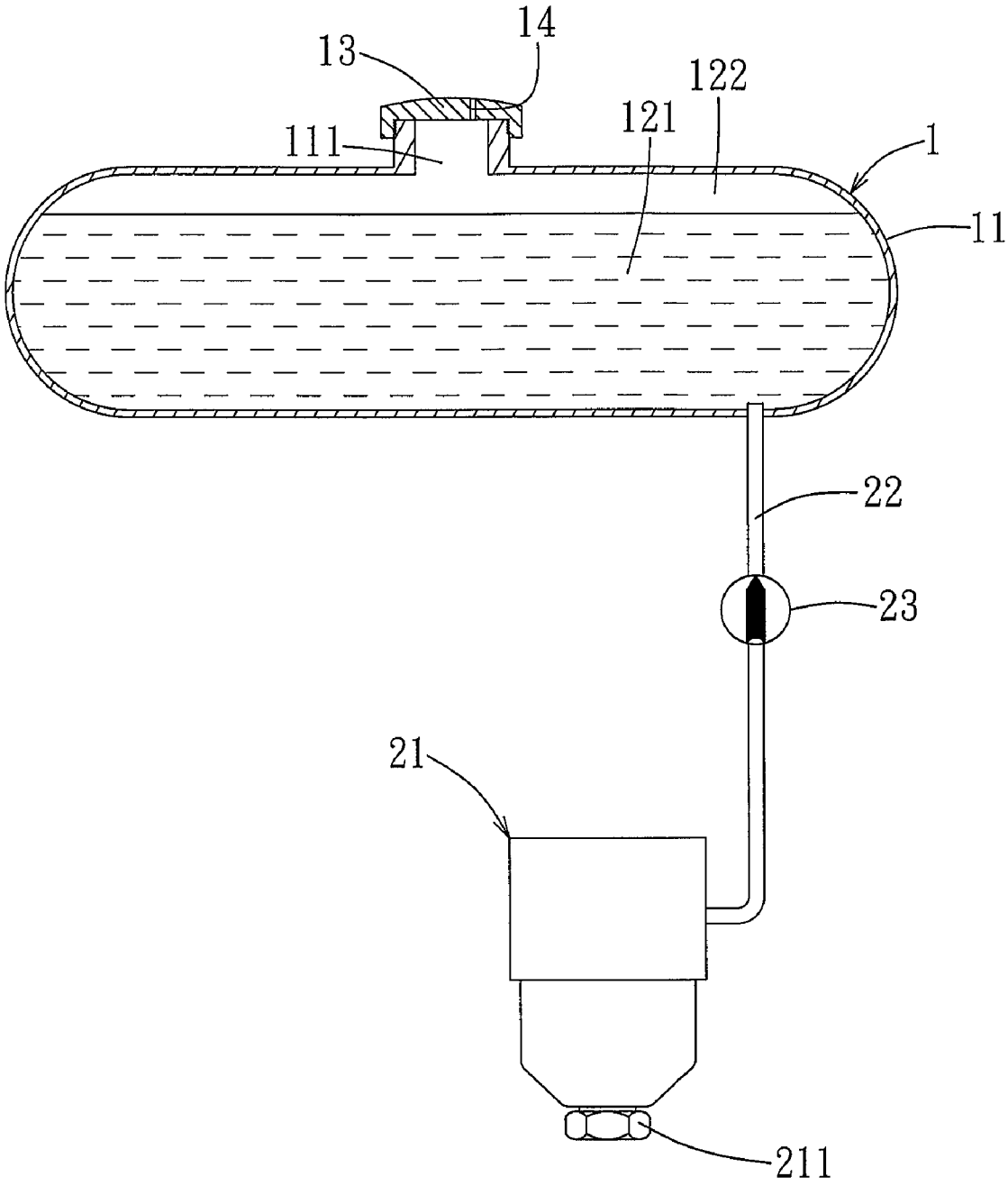
FIG. 1 PRIOR ART
FIG. 1 is a schematic diagram for illustrating a conventional combustible fuel supply system.
Figure 2:
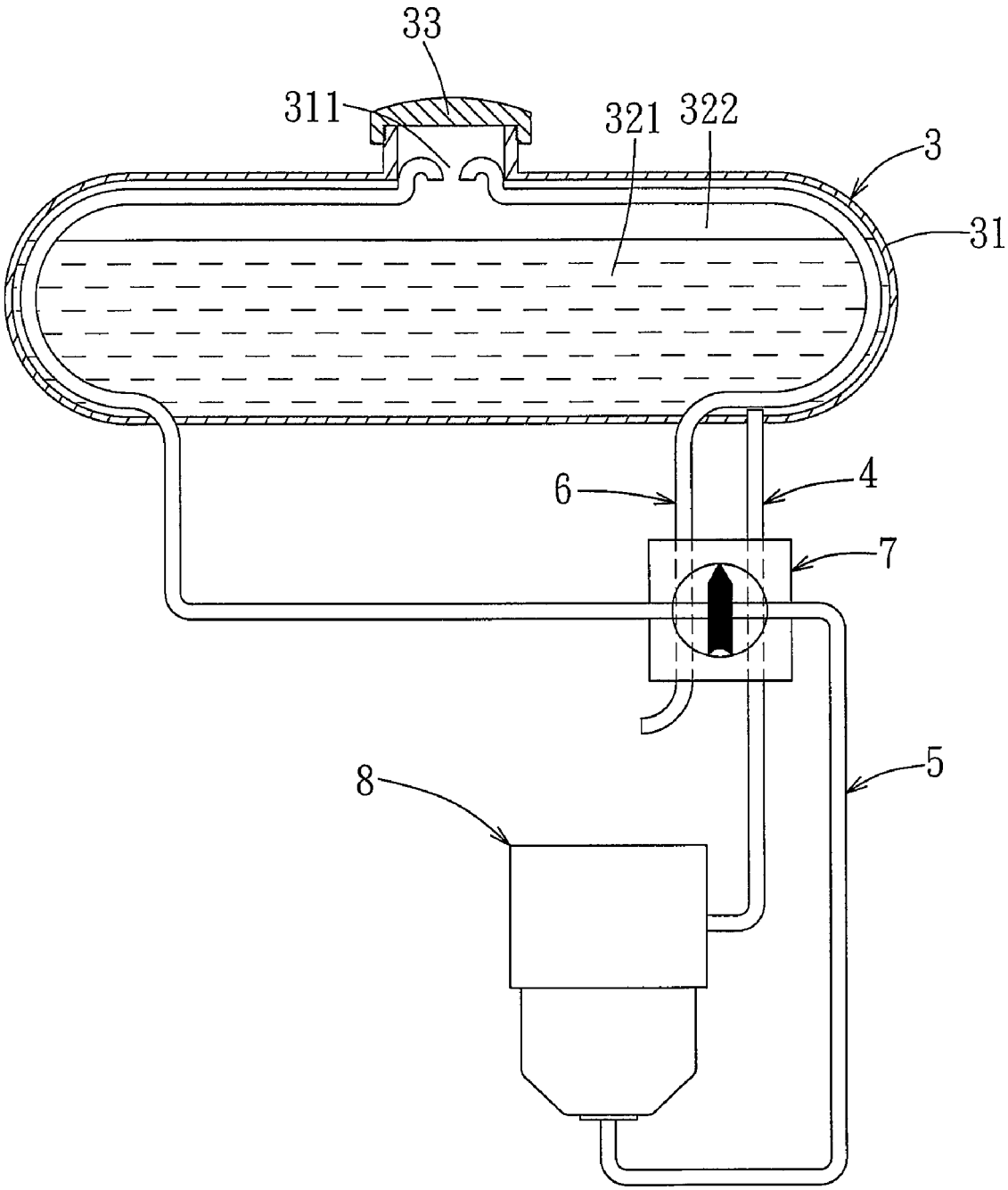
FIG. 2 is a schematic diagram for illustrating a preferred embodiment of a combustible fuel supply system of the present invention, and showing a switch valve of the system in a fuel-feeding state.
Figure 3:
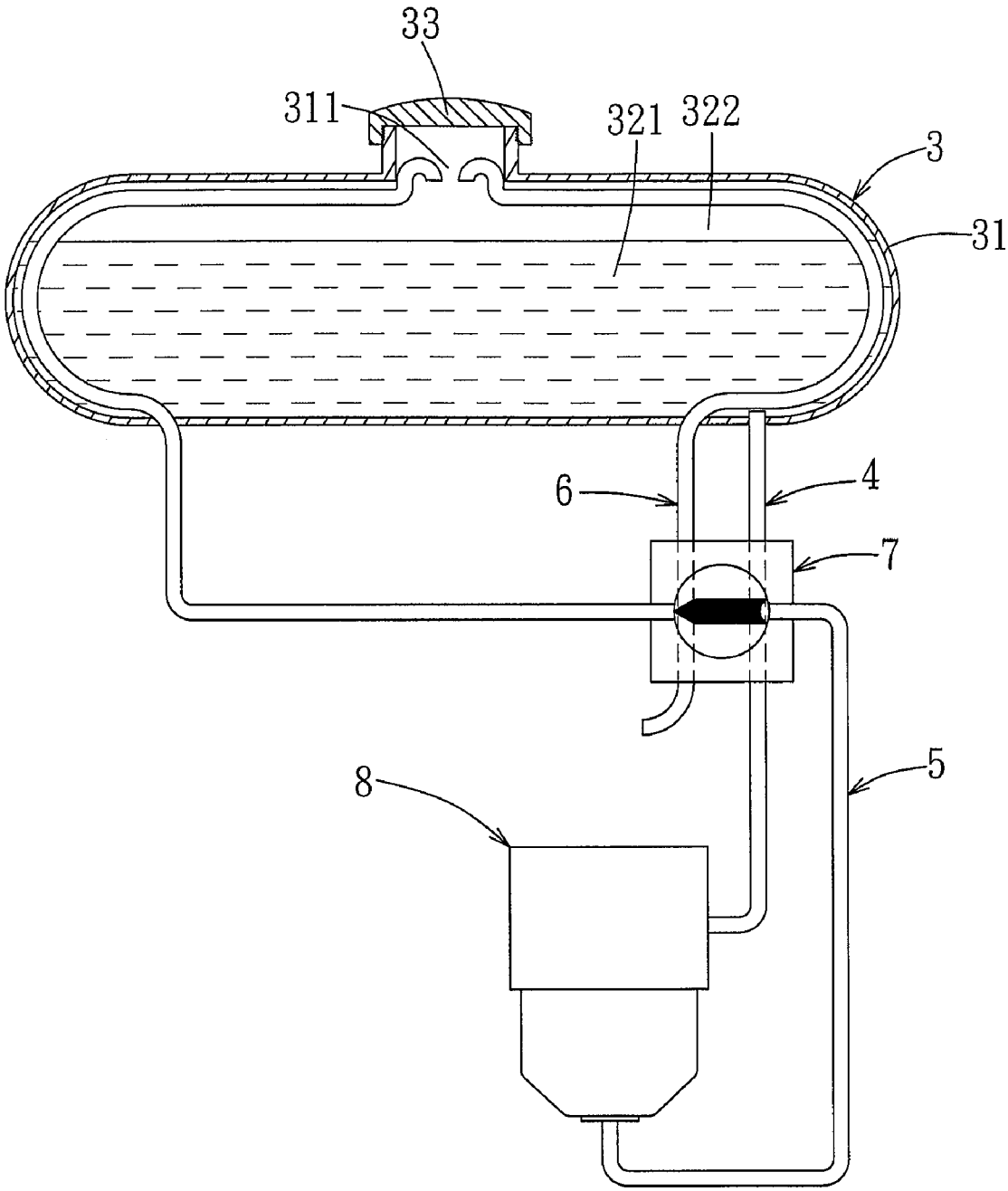
FIG. 3 is a schematic diagram similar to FIG. 2, but illustrating the switch valve in a fuel-drawing state.

Referring to FIGS. 2 and 3, the preferred embodiment of combustible fuel supply system according to this invention includes a fuel tank 3, a carburetor 8, and a combustible fuel piping system interconnecting the fuel tank 3 and the carburetor 8. The combustible fuel piping system includes a fuel-feeding pipe 4, a fuel-drawing pipe 5, a vent pipe 6, and a switch valve 7.

The fuel tank 3 is used for storing combustible fuel, and includes a casing 31 formed with an opening 311, and a cap 33 for removably covering the opening 311. The casing 31 defines an upper space 322 and a lower space 321 in fluid communication with each other. The lower space 321 is adapted for storing combustible fuel. The upper space 322 is adapted for accommodating air when the lower space 321 stores the combustible fuel.

The carburetor 8 is used for atomizing the combustible fuel from the fuel tank 3 so as to produce a mixture of combustible fuel and air, and provides the mixture of the combustible fuel and air to an engine (not shown) coupled thereto.

The fuel-feeding pipe 4 interconnects the lower space 321 of the fuel tank 3 and the carburetor 8 for providing the combustible fuel from the fuel tank 3 to the carburetor 8. The fuel-drawing pipe 5 interconnects the upper space 322 of the fuel tank 3 and the carburetor 8 for drawing the combustible fuel out of the carburetor 8 and permitting return flow of the combustible fuel from the carburetor 8 back to the fuel tank 3. The vent pipe 6 is used for fluid communication between the upper space 322 and the exterior of the fuel tank 3 such that the pressure in the upper space 322 is equal to the atmospheric pressure and is not a negative pressure compared with the pressure in the carburetor 8. Further, operation of the engine causes the carburetor 8 to generate a force that causes the combustible fuel stored in the lower space 321 of the fuel tank 3 to flow into the carburetor 8 through the fuel-feeding pipe 4.

The switch valve 7 is connected to the fuel-feeding pipe 4, the fuel-drawing pipe 5 and the vent pipe 6, and is operable to obstruct or permit fluid flow through at least one of the fuel-feeding pipe 4, the fuel-drawing pipe 5 and the vent pipe 6.

The switch valve 7 is operable to switch between a fuel-feeding state as shown in FIG. 2 and a fuel-drawing state as shown in FIG. 3. When the switch valve 7 is in the fuel-feeding state, the fluid flow through the fuel-feeding pipe 4 and the vent pipe 6 is permitted, and the lower space 321 and the carburetor 8 are in fluid communication through the fuel-feeding pipe 4. By virtue of the vent pipe 6, the pressure inside the fuel tank 3 is equal to the atmospheric pressure. The operation of the engine causes the carburetor 8 to generate the force for causing the combustible fuel stored in the lower space 321 of the fuel tank 3 to flow into the carburetor 8 through the fuel-feeding pipe 4. Then, the carburetor 8 atomizes the combustible fuel, and the resulting mixture of the combustible fuel and air is fed into the engine. At this time, the fluid flow through the fuel-drawing pipe 5 is obstructed so as to prevent return flow of the mixture in the carburetor 8 to the fuel tank 3.

When the switch valve 7 is in the fuel-drawing state, the fluid flow through the fuel-feeding pipe 4 and the vent pipe 6 is obstructed such that the combustible fuel stored in the lower space 321 of the fuel tank 3 will not flow into the carburetor 8. The fluid flow through the fuel-drawing pipe 5 is permitted, and the upper space 322 and the carburetor 8 are in fluid communication through the fuel-drawing pipe 5. Temperature of the combustible fuel stored in the lower space 321 of the fuel tank 3, which has increased due to the operation of the engine, will be gradually decreased. However, since the fluid flow through the vent pipe 6 is obstructed, the upper space 322 of the fuel tank 3 is not in fluid communication with the exterior of the fuel tank 3. Therefore, the pressure inside the fuel tank 3 is decreased with decrease of the temperature of the combustible fuel such that the pressure in the upper space 322 of the fuel tank 3 is a negative pressure compared with the pressure in the carburetor 8. By virtue of a pressure difference between the upper space 322 and the carburetor 8, the combustible fuel is automatically drawn out of the carburetor 8 and is returned to the fuel tank 3.

In summary, the switch valve 7 is operable to switch between the fuel-feeding state and the fuel-drawing state for obstructing or permitting the fluid flow through at least one of the fuel-feeding pipe 4, the fuel-drawing pipe 5 and the vent pipe 6. When the switch valve 7 is in the fuel-feeding state, the combustible fuel stored in the lower space 321 is fed into the carburetor 8 through the fuel-feeding pipe 4. When the switch valve 7 is in the fuel-drawing state, the combustible fuel is automatically drawn out of the carburetor 8 and is returned to the fuel tank 3 without requiring further manual operation.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A combustible fuel piping system adapted for interconnecting a fuel tank and a carburetor, the fuel tank including a casing that defines an upper space and a lower space in fluid communication with each other, the lower space being adapted for storing combustible fuel, the upper space being adapted for accommodating air when the lower space stores the combustible fuel, said combustible fuel piping system comprising:

a fuel-feeding pipe adapted for interconnecting the lower space of the fuel tank and the carburetor;

a fuel-drawing pipe adapted for interconnecting the upper space of the fuel tank and the carburetor;

a vent pipe adapted for fluid communication between the upper space and the exterior of the fuel tank; and a switch valve operable to obstruct fluid flow through at least one of said fuel-feeding pipe, said fuel-drawing pipe and said vent pipe, said switch valve being operable to switch between a fuel-feeding state and a fuel-drawing state;

wherein, when said switch valve is in the fuel-feeding state, fluid flow through said fuel-drawing pipe is obstructed, fluid flow through said fuel-feeding pipe and said vent pipe is permitted, and the lower space and the carburetor are in fluid communication through said fuel-feeding pipe so as to feed the combustible fuel stored in the lower space to the carburetor; and wherein, when said switch valve is in the fuel-drawing state, fluid flow through said fuel-feeding pipe and said vent pipe is obstructed, fluid flow through said fuel-drawing pipe is permitted, and the upper space and the carburetor are in fluid communication through said fuel-drawing pipe so as to draw combustible fuel out of the carburetor by virtue of a pressure difference between the fuel tank and the carburetor.

2. A combustible fuel supply system comprising:

a fuel tank including a casing that defines an upper space and a lower space in fluid communication with each other, said lower space being adapted for storing combustible fuel, said upper space being adapted for accommodating air when said lower space stores the combustible fuel;

a carburetor; and a combustible fuel piping system including a fuel-feeding pipe interconnecting said lower space of said fuel tank and said carburetor, a fuel-drawing pipe interconnecting said upper space of said fuel tank and said carburetor, a vent pipe for fluid communication between said upper space and the exterior of said fuel tank, and a switch valve operable to obstruct fluid flow through at least one of said fuel-feeding pipe, said fuel-drawing pipe and said vent pipe, said switch valve being operable to switch between a fuel-feeding state and a fuel-drawing state;

wherein, when said switch valve is in the fuel-feeding state, fluid flow through said fuel-drawing pipe is obstructed, fluid flow through said fuel-feeding pipe and said vent pipe is permitted, and said lower space and said carburetor are in fluid communication through said fuel-feeding pipe so as to feed the combustible fuel stored in said lower space to said carburetor; and wherein, when said switch valve is in the fuel-drawing state, fluid flow through said fuel-feeding pipe and said vent pipe is obstructed, fluid flow through said fuel-drawing pipe is permitted, and said upper space and said carburetor are in fluid communication through said fuel-drawing pipe so as to draw combustible fuel out of said carburetor by virtue of a pressure difference between said fuel tank and said carburetor.

* * * * *